US007895873B1

(12) United States Patent
McLean

(10) Patent No.: US 7,895,873 B1
(45) Date of Patent: Mar. 1, 2011

(54) METHOD AND SYSTEM FOR SIMULTANEOUSLY FORGING TWO PARTS

(75) Inventor: Carl McLean, Conneaut Lake, PA (US)

(73) Assignee: Meadville Forging Co LP, Meadville, PA (US)

( * ) Notice: Subject to any disclaimer, the term of this patent is extended or adjusted under 35 U.S.C. 154(b) by 458 days.

(21) Appl. No.: 12/107,950

(22) Filed: Apr. 23, 2008

(51) Int. Cl.
*B21D 22/00* (2006.01)

(52) U.S. Cl. ..... 72/356; 72/340; 72/352; 29/414

(58) Field of Classification Search ..... 72/340, 72/344, 352, 356, 358, 359, 360; 29/412, 29/414, 415, 416
See application file for complete search history.

(56) References Cited

U.S. PATENT DOCUMENTS 1,606,282 A * 11/1926 Witter ..... 29/890.14
1,683,011 A * 9/1928 Andren ..... 29/413
3,069,756 A * 12/1962 Colestock ..... 29/893.36
3,142,115 A * 7/1964 Guillaume ..... 29/416
3,750,442 A * 8/1973 Cogan ..... 72/57
4,510,788 A * 4/1985 Ferguson et al. ..... 72/377
4,543,812 A * 10/1985 Theobald ..... 72/355.4
4,590,780 A * 5/1986 Bachmann ..... 72/328
6,065,322 A * 5/2000 Tabata et al. ..... 72/334

FOREIGN PATENT DOCUMENTS

JP 1-313123 * 12/1989

OTHER PUBLICATIONS

"Forging Handbook"—T.G. Byrer—p. 202—Manufacture of Forgings Library of Congress Catalog No. 85-071789-1985.

* cited by examiner

*Primary Examiner*—Edward Tolan
(74) *Attorney, Agent, or Firm*—Schiff Hardin LLP

(57) ABSTRACT

In a method or system for simultaneously forging parts, a forging die is provided with a bottom part and a top part, the forging die having a first forging cavity, a second forging cavity surrounding the first forging cavity, and a connecting opening between the first forging cavity and the second forging cavity. A billet is placed in a lower portion of at least one of the first forging cavity, the second forging cavity, and the connecting opening, and then with a forging press, the forging die is closed so that the die bottom part and die upper part approach one another to cause material of the billet to spread throughout the first forging cavity, the connecting opening, and the second forging cavity. The forging die is opened and a resulting unified forging part is removed formed of a first forging part, a second forging part, and a connecting region. The first forging part and the second forging part are separated at the connecting region. Since the first and second parts are forged simultaneously and with a common material, they have similar characteristics.

18 Claims, 2 Drawing Sheets

METHOD AND SYSTEM FOR SIMULTANEOUSLY FORGING TWO PARTS

BACKGROUND

Previously it was known for forging two separate parts to use two separate forging dies in two separate forging presses, or in a common forging press. A separate die for each part was employed with each die having a forging cavity receiving a billet in order to manufacture the two separate parts. It was also known to have a common die in a single forging press for forging two separate parts simultaneously in the common die, but with the respective cavities for the respective parts being side-by-side.

SUMMARY

It is an object to provide a new improved type of forging die for use in a single press for simultaneously forging two separate parts.

In a method or system for simultaneously forging parts, a forging die is provided with a bottom part and a top part, the forging die having a first forging cavity, a second forging cavity surrounding the first forging cavity, and a connecting opening between the first forging cavity and the second forging cavity. A billet is placed in a lower portion of at least one of the first forging cavity, the second forging cavity, and the connecting opening. Then, with a forging press, the forging die is closed so that the die bottom part and die upper part approach one another to cause material of the billet to spread throughout the first forging cavity, the connecting opening and the second forging cavity. The forging die is opened and a resulting unified forging part is removed formed of a first forging part, a second forging part surrounding the first forging part, and a connecting region. The first forging part and the second forging part are then separated at the connecting region.

DESCRIPTION OF THE PREFERRED EMBODIMENT

Figure 2:
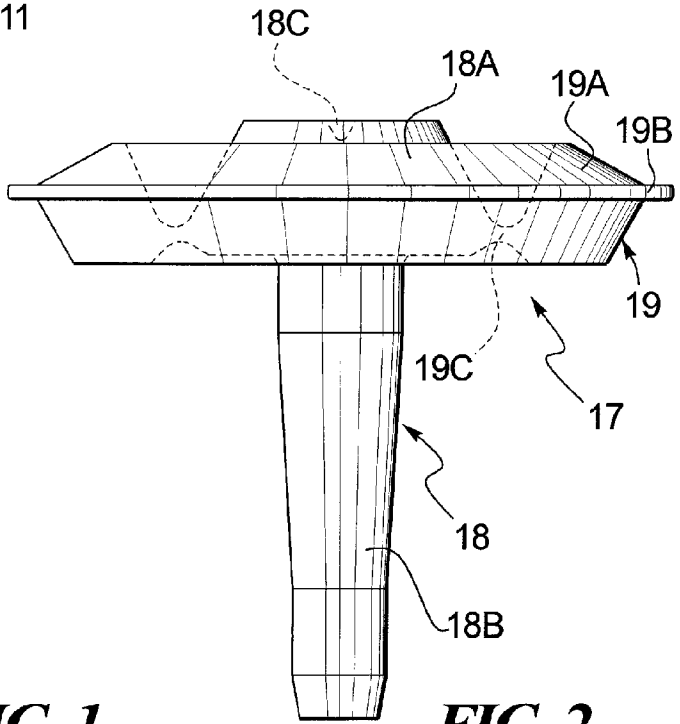
FIG. 2 is a side view of a resulting inner forging part connected to the outer forging part after removal from the forging die of FIG. 1.

For purposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

Figure 1:
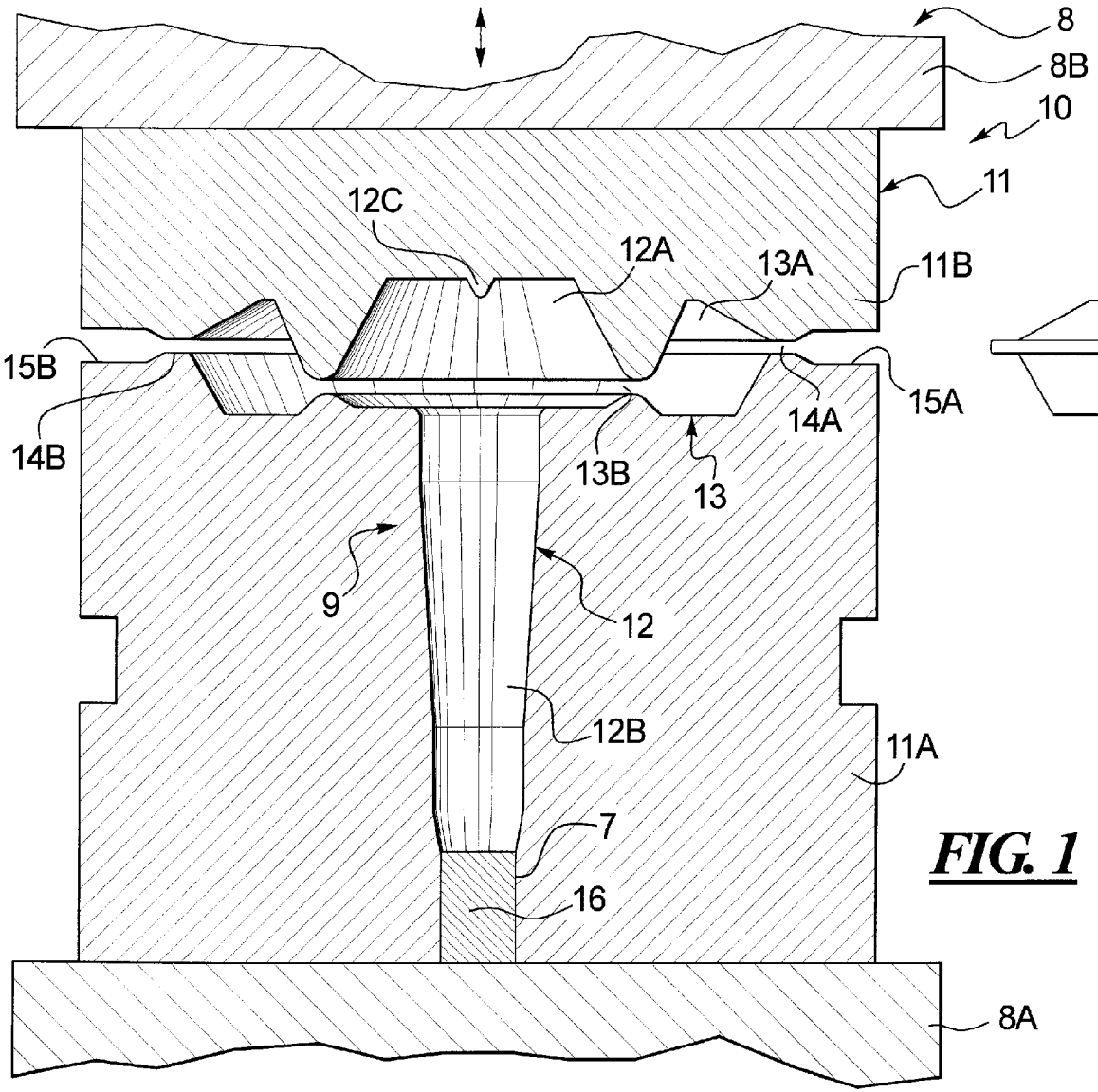
FIG. 1 is a cross-sectional view of a forging system for simultaneously forging two parts in a common cavity resulting in an inner forging part and an outer forging part (part-in-part) surrounding the inner forging part.

FIG. 1 is a cross-sectional view of a forging system generally illustrated at 10 employing a forging die 11 having a bottom die part 11A and a top die part 11B. The forging die 11 is mounted in a forging press 8 having a bottom press bed 8A and a movable press ram 8B.

Between the bottom die part 11A and top die part 11B a common forging cavity 9 for both an inner forging part and an outer forging part surrounding the inner forging part is located. A top part of the forging cavity 9 is provided in the top die part 11B and a lower part of the forging cavity resides in the bottom die part 11A.

The cavity 9 shown in FIG. 1 is particularly designed for illustrating in this exemplary embodiment the manufacture of a pinion gear as the inner forging part and a cooperating ring gear as the outer forging part. The pinion gear and the ring gear are merely exemplary, and many other types of parts may be simultaneously forged with the forging process.

In FIG. 1 the pinion gear cavity 12 (inner forging cavity) is formed by a shaft portion 12B and a pinion gear portion 12A having a centering projection 12C. The ring gear cavity 13 (outer forging cavity) has a ring gear portion 13A and a circumferential narrow connecting opening 13B connecting the inner forging cavity 12 for the pinion gear with the outer forging cavity 13 for the ring gear. As also shown in FIG. 1, the shaft portion 12B in the bottom die part 11A is many times deeper than a lower portion of the outer forging cavity 13 in the bottom die part 11A.

A circumferential excess material flow gap 14A surrounds the ring gear cavity portion 13A leading to a widened circumferential excess material exit region 15A.

An ejector pin 16 is provided in the bottom die portion 11A in an aperture 7 in the bottom of the bottom die portion 11A.

A hot malleable billet of the material to be used in the forging (such as metal or other materials) may be a hot rolled bar stock that is cut into a short piece of a desired size. Alternatively, the hot malleable billet may be formed by other earlier forging operations of many different types. This billet is placed in the forging cavity 9 when the press ram 8B opens the die (upper position). As the press ram 8B descends, the heated malleable billet is compressed and flows throughout the cavity 9, including in the narrow connecting opening 13B, in the inner and outer cavities 12 and 13, and through the excess material flow gap 14A into the exit region 15A. Thus the same billet is used for forging the inner forging part 18 (pinion gear 18A with shaft 18B) and the outer forging part 19 (ring gear). The two parts prior to separation as illustrated in FIG. 2 are joined by a circumferential connecting web or region 19C as a unified forging part 17. A centering dimple 18C is provided at the top of the pinion gear 18A connecting to the lower pinion gear shaft 18B.

The billet may be placed in the inner cavity 12, outer cavity 13, in the connecting opening 13B, or any combination.

Figure 3:
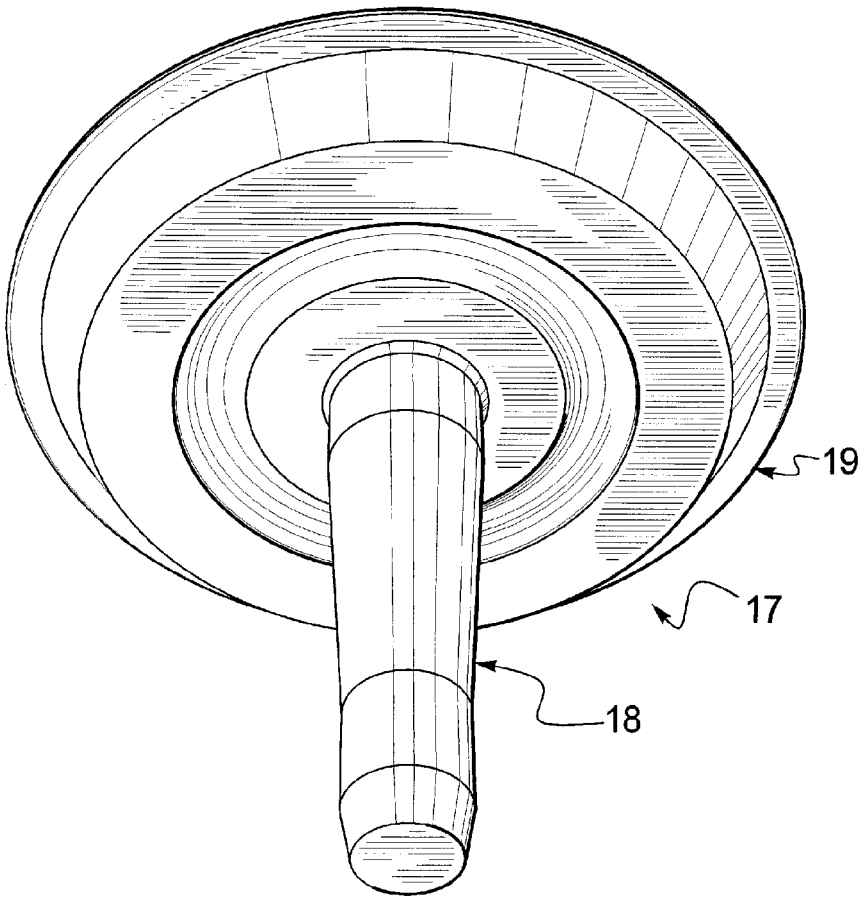
FIG. 3 is a perspective view of the inner forging part and the outer forging part shown in FIG. 2.

FIG. 3 shows a perspective view of the inner forging part 18 and the outer forging part 19 of the unified forging part 17 prior to separation creating a "part-in-part" configuration.

Figure 4:
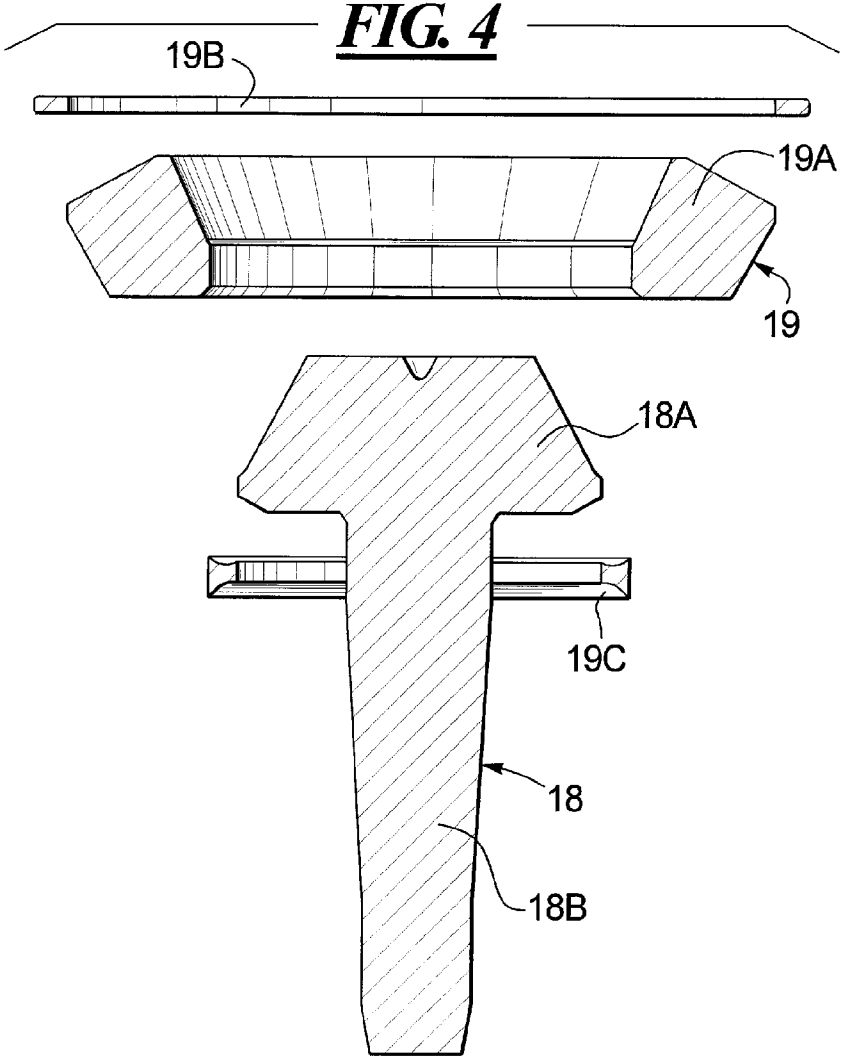
FIG. 4 is an exploded view of the inner forging part after separation from the outer forging part.

FIG. 4 shows the separation of the inner forging part 18 and outer forging part 19 by cutting away the inner flash ring 19C (circumferential connecting web), which constituted scrap. Similarly an outer flash ring 19B formed of excess material is cut away, which also constitutes scrap. Additional processing such as heat treating, cutting the gear teeth, etc. may now be performed depending on the type of part involved.

Although metal is described for the heated and malleable forging ingot, other types of material may also be employed as desired depending on the type of forging and the type of parts being manufactured.

In the prior art, the center section of the forging is normally pierced out and scrapped. With the present method and system, a smaller forging is formed in the center of a larger forging and the two forgings are thus produced at the same time. The two forgings as described above are then separated in the trimming and pierce operation.

With the present preferred embodiment, the process allows two parts to be forged together from one piece of steel and then are separated in the trimming and pierce operation.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

I claim as my invention:

1. A method for simultaneously forging first and second parts, comprising the steps of:

providing a forging die with a bottom part and a top part, said forging die having an inner forging cavity, an outer forging cavity surrounding the inner forging cavity, and a circumferential connecting opening between the inner forging cavity and the outer forging cavity and surrounding the inner cavity, a lower portion of the inner forging cavity in said bottom part being a single elongated shaft portion as a recess centrally located with respect to said surrounding outer forging cavity so as to form a single elongated shaft for said first part, and a depth of said elongated shaft portion of said inner forging cavity in said forging die bottom part being many times greater than a depth of a lower portion of said outer forging cavity in said forging die bottom part;

placing a billet in a lower portion of at least one of the inner forging cavity, the outer forging cavity, and the connecting opening, and then with a forging press closing the forging die such that the die bottom part and upper part approach one another to cause material of the billet to spread throughout the inner forging cavity, the connecting opening, and the outer forging cavity, and wherein excess ingot material is forced out a circumferential excess material flow gap connecting to and surrounding the outer forging cavity at an exit region of the die;

opening the forging die and removing a resulting unified forging part formed of an inner forging part and an outer forging part joined by a connecting region of material; and separating the inner forging part and the outer forging part at the connecting region to create said first and second parts and also removing an outer flashing of excess material from and completely surrounding said outer forging part.

2. A method of claim 1 wherein said connecting region of material comprises a web and said web is removed to separate said inner and outer forging parts.

3. A method of claim 1 wherein said inner forging part comprises a pinion gear in which gear teeth are to be later formed and said outer forging part comprises a ring gear in which gear teeth are later formed.

4. A method of claim 1 wherein said billet comprises a heated malleable metal.

5. A method of claim 4 wherein said metal billet comprises steel.

6. A method of claim 1 wherein an ejector pin is provided to eject said unified forging part from said inner and outer cavities when said forging die is opened.

7. A method of claim 1 wherein said inner forging cavity has said lower portion in said die bottom part and an upper portion in said die top part, and said outer forging cavity has said lower portion in said die bottom part and a top portion in said die top part.

8. A method of claim 1 wherein said connecting region of material comprises a web and said web is removed to separate said inner and outer forging parts, said removed web forming a scrap ring.

9. A method of claim 1 wherein said removed outer flashing of excess material forms a scrap ring.

10. A method of claim 1 wherein said billet is placed only in said lower inner cavity.

11. A method of claim 1 wherein said billet is placed in only one of least said lower inner and outer cavities.

12. A method for simultaneously forging first and second parts, comprising the steps of:

providing a forging die with a bottom part and a top part, said forging die having a first forging cavity, a second forging cavity surrounding the first forging cavity, and a circumferential connecting opening between the first forging cavity and the second forging cavity and surrounding the inner cavity, a lower portion of the inner forging cavity in said bottom part being a single elongated shaft portion as a recess centrally located with respect to said surrounding outer forging cavity so as to form a single elongated shaft for said first part, and a depth of said elongated shaft portion of said inner forging cavity in said forging die bottom part being many times greater than a depth of a lower portion of said outer forging cavity in said forging die bottom part;

placing a billet in a lower portion of at least one of the first forging cavity, the second forging cavity, and the connecting opening, and then with a forging press closing the forging die such that the die bottom part and upper part approach one another to cause material of the billet to spread throughout the first forging cavity, the connecting opening, and the second forging cavity, and wherein excess ingot material is forced out a circumferential excess material flow gap connecting to and surrounding the outer forging cavity at an exit region of the die, said excess material flow gap having a narrow portion followed by a widened portion at said exit region of the die;

opening the forging die and removing a resulting unified forging part formed of a first forging part and a second forging part surrounding the first part and joined by a connecting region of material; and separating the first forging part and the second forging part at the connecting region and also removing an outer circumferential flashing of excess material from and entirely surrounding said outer forging part.

13. A method of claim 12 wherein the billet is placed in the first forging cavity and when the forging press is closed the billet material then flows from the first forging cavity through the connecting opening and into the second forging cavity.

14. A forging die system for simultaneously forging first and second parts, comprising:

a forging die with a bottom part and a top part, said forging die having an inner forging cavity for the first part, an outer forging cavity for the second part surrounding the inner forging cavity, and a connecting opening between the inner forging cavity and the outer forging cavity and surrounding the inner cavity;

a lower portion of the inner forging cavity in said bottom part being a single elongated shaft portion as a recess centrally located with respect to said surrounding outer forging cavity so as to form a single elongated shaft for said first part, and a depth of said elongated shaft portion of said inner forging cavity in said forging die bottom part being many times greater than a depth of a lower portion of said outer forging cavity in said forging die bottom part; and a circumferential excess material flow a connecting to and surrounding the outer forging cavity at an exit region of the die for forcing out excess ingot material.

15. A system of claim 14 wherein said inner forging part comprises a pinion gear in which gear teeth are to be later formed and said outer forging part comprises a ring gear in which gear teeth are later formed.

16. A system of claim 14 wherein an ejector pin is provided to eject a unified forging part from said inner and outer cavities when said forging die is opened.

17. A system of claim 14 wherein said inner forging cavity has said shaft portion in said die bottom part and an upper portion in said die top part, and said outer forging cavity has said bottom portion in said die bottom part and a top portion in said die top part.

18. A system of claim 14 wherein said excess material flow gap has a narrow portion and a widened portion at said exit region of the die.

* * * * *